US007128385B2

(12) United States Patent
Bush, III et al.

(10) Patent No.: US 7,128,385 B2
(45) Date of Patent: Oct. 31, 2006

(54) SYSTEM AND METHOD FOR INK JET PRINTHEAD DETECTION

(75) Inventors: James L. Bush, III, Lexington, KY (US); Marenz S. Ganadillo, Lexington, KY (US); Tommy O. Lowe, Lexington, KY (US); Bryan D. McKinley, Lexington, KY (US); Douglas L. Robertson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 245 days.

(21) Appl. No.: 10/880,904

(22) Filed: Jun. 30, 2004

(65) Prior Publication Data

US 2006/0001687 A1 Jan. 5, 2006

(51) Int. Cl.
*B41J 29/393* (2006.01)
*B41J 29/38* (2006.01)

(52) U.S. Cl. ..... 347/19; 347/5

(58) Field of Classification Search ..... 347/19
See application file for complete search history.

(56) References Cited

U.S. PATENT DOCUMENTS 6,081,280 A * 6/2000 Bolash et al. ..... 347/9
6,102,515 A * 8/2000 Edwards et al. ..... 347/17

* cited by examiner

*Primary Examiner*—Vip Patel
*Assistant Examiner*—Jannelle M. Lebron
(74) *Attorney, Agent, or Firm*—Ronald K. Aust

(57) ABSTRACT

The invention provides a system and method for detecting the presence of an ink jet printhead when a printhead controller fails to properly identify an installed printhead using a printhead identification device. The system includes a printhead including heater resistors and control elements, and a controller connected to the printhead via address and data lines. When the controller fails to properly identify an installed printhead, the controller operates to bias the control elements in a predetermined manner via at least one address line, detect a signal via the data lines, and generate a signal indicative of the presence of the installed printhead.

20 Claims, 1 Drawing Sheet

SYSTEM AND METHOD FOR INK JET PRINTHEAD DETECTION

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a system and method for detecting the presence of a thermal ink jet printhead in the event that the primary detection method fails to properly identify an installed printhead.

2. Description of the Related Art

Thermal ink jet printers apply ink to a print medium such as paper by ejecting ink drops from a printhead through an array of nozzles. Each nozzle is associated with a heater resistor that generates heat when sufficient current passes through it to cause ink within an associated ink reservoir to be ejected from the nozzle. The printhead ejects ink as it is passed over the print medium in a series of passes, with the print medium being advanced between passes. A printhead controller determines which resistors will be "fired" and the proper firing sequence so that a desired image can be printed on the medium.

Typically, printheads are in the form of replaceable printhead cartridges, with each printhead cartridge including one or more ink colors. Often, the printhead controller requires the input of information identifying the type of installed cartridge so that the controller can be adjusted for proper printer operation. Various printhead identification schemes and devices are known which operate to provide identification information to the printhead controller, including information relating to cartridge presence and type. One such printhead identification device is described in U.S. Pat. No. 6,161,915 (assigned to the same assignee as the present invention), wherein the printhead identification device is described as being manufactured as part of the printhead cartridge. In general, such devices reliably provide identification information to the controller. However, if the printhead identification device is damaged or improperly manufactured, the controller may deem a cartridge missing, even though it is actually installed and will still print as designed.

Inaccurate detection of printheads is especially problematic in stand-alone All-In-One devices that provide printing, copying, scanning, facsimile services, memory card readers, or some combination of the foregoing functionality. With an all-in-one device, the device itself must make the determination of printhead presence for user feedback. Therefore, another printhead detection scheme is needed to supplement the present identification schemes.

SUMMARY OF THE INVENTION

The invention provides a system and method for detecting the presence of an ink jet printhead. The system includes a printhead including an array of thermally activated heater elements for ejecting ink, each heater element having an associated control element. The system also includes a printhead identification device and a printhead controller. The printhead controller includes address line drivers and data line drivers for transmitting signals to the printhead via a plurality of address lines and data lines to selectively activate the heater elements for ejecting ink. The printhead controller receives information from the printhead identification device to identify the type of printhead installed. When the printhead controller fails to properly identify an installed printhead, the printhead controller operates to bias the control elements in a predetermined manner via at least one address line and one select line, detects a signal via the data lines, and generates a signal indicative of the presence of the installed printhead.

Other features and advantages of the invention will become apparent to those skilled in the art upon review of the following detailed description, claims, and drawings.

DETAILED DESCRIPTION OF THE PREFERRED EMBODIMENTS

Figure 1:
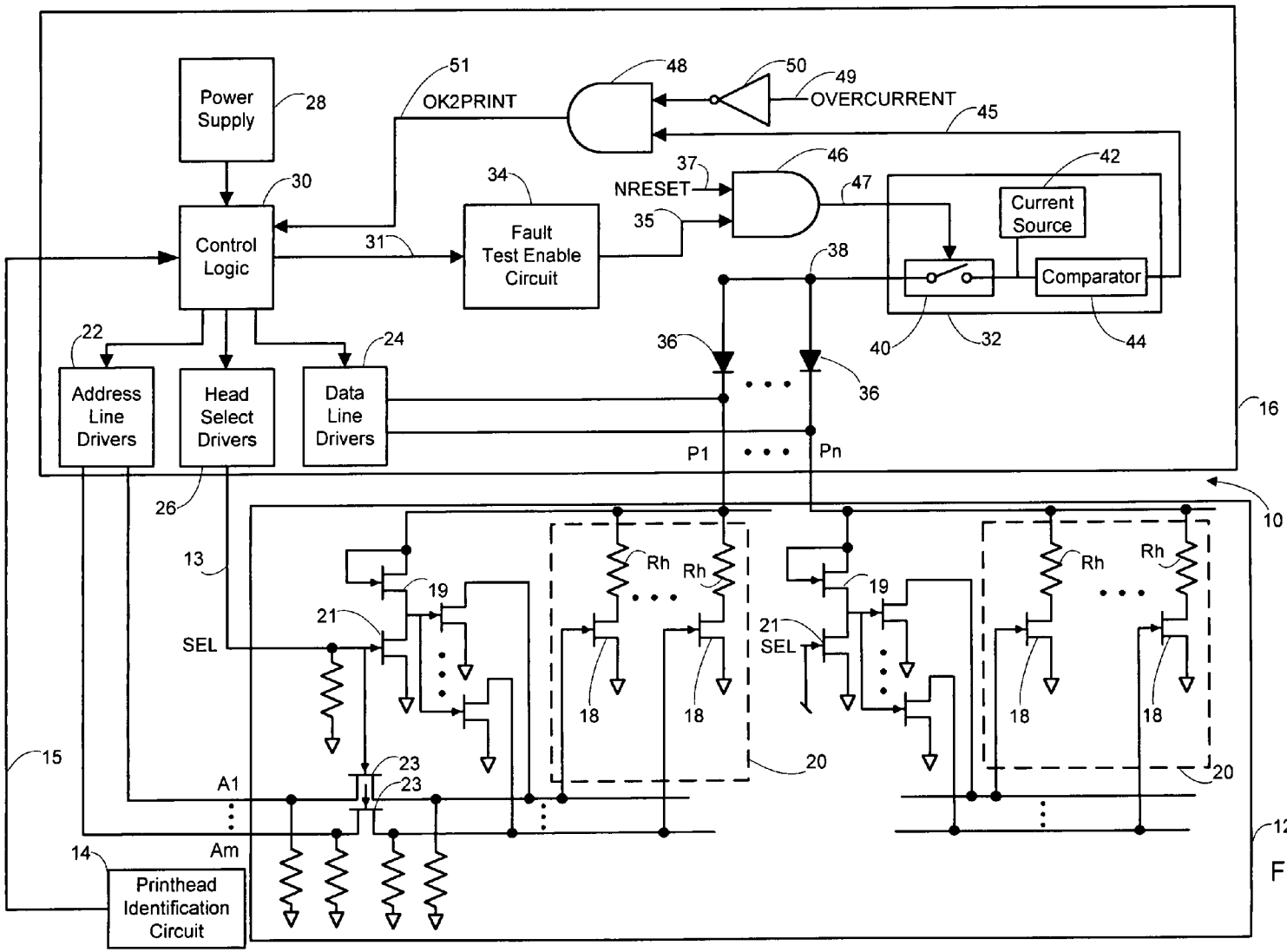
FIG. 1 illustrates one embodiment of a system for detecting the presence of an ink jet printhead in the event that the printer controller fails to properly detect an installed printhead.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. The order of limitations specified in any method claims does not imply that the steps or acts set forth therein must be performed in that order, unless an order is explicitly set forth in the specification.

In addition, it should be understood that embodiments of the invention include both hardware and electronic components or modules that, for purposes of discussion, may be illustrated and described as if the majority of the components were implemented solely in hardware. Similarly, components may be described as if they were implemented solely in software. However, one of ordinary skill in the art, and based on a reading of this detailed description, would recognize that, in at least one embodiment, the electronic based aspects of the invention may be implemented in software or hardware. As such, it should be noted that a plurality of hardware and software based devices, as well as a plurality of different structural components may be utilized to implement the invention.

Illustrated in FIG. 1 is one embodiment of a system 10 for detecting the presence of an ink jet printhead. In particular, system 10, part of an ink jet printer, includes at least one printhead 12, a printhead identification device 14, and a printhead controller 16 coupled to the printhead 12 by address lines A1 through Am, data lines P1 through Pn, and at least one head select line, SEL, 13. The printhead controller 16 and the printhead 12 together operate to selectively apply ink to a print medium such as paper by ejecting ink drops from the printhead in order to print a desired image.

Specifically, the printhead 12 includes a plurality of thermally activated heater elements, such as resistors Rh, each having an associated control element, such as a field effect transistor (FET) 18, as well as an associated ink reservoir and nozzle (not shown). The FETs 18 and resistors Rh are arranged in a plurality of groups 20 shown within the dashed lines, with each data line being coupled to one of the groups 20 in the printhead 12. For example, each FET at its source or drain connects to an associated resistor Rh, with a given data line being connected to all of the heater resistors of a given group 20. Each address line is coupled to the gate of a corresponding FET 19 in every group 20. The select line SEL is connected to the gate of FET 21 and the gate of FET 23 associated with each group 20 in the printhead 12 for controlling the operation of both the data lines and address lines. The address lines A1–Am from controller 16 are connected to the drain or source of FET 23 in printhead 12. The printhead controller includes a plurality of address line drivers 22, data line drivers 24, and head select drivers 26 that operate to transmit signals on respective lines to the printhead 12. The controller 16 further includes a power supply 28 for supplying power to these drivers as well as to various other circuits, including for example, a control logic circuit 30, a detection circuit 32, and a fault test enable circuit 34. The control logic circuit 30 controls the drivers 22, 24, 26 to provide the desired signals, such as voltages, on the address lines, data lines, and head select line that are transmitted to the printhead 12.

An active signal on the head select line SEL 13 permits an active signal on a data line P to bias the control elements of its associated group 20, while an inactive signal on the head select line SEL 13 prevents an active signal on a data line P from biasing associated control elements. In order to print a desired image, an active signal is provided on the head select line SEL 13. This allows an active signal on any one of the data lines P to turn on or bias the FETS in its associated group 20. For example, driving the P1 data line to an active (high) state allows all of the heater resistors Rh in group 20 to be enabled. An individual heater resistor Rh in group 20 is then turned on if its particular A (address) line is also active by being driven to a high state. In such a case, current is then conducted through the heater resistor Rh to locally heat the ink in an associated ink reservoir. When sufficient current passes through a heater resistor Rh, ink is ejected through the nozzle onto the print medium.

The detection circuit 32 is operable to detect faults, such as shorts, in the data lines of a printhead 12. Specifically, the controller 16 further includes a plurality of diodes 36, each diode being connected at one terminal (cathode end) to a corresponding one of the data lines. A second terminal (anode end) of each diode is connected in common to the others at a node 38, which is connected to the detection circuit 32. The detection circuit 32 includes a switch 40, a current source 42, and a comparator 44, and is controlled to read a voltage at node 38. For example, when a printhead 12 is installed, it is desirable to detect whether faults (such as a path to ground) exist on one or more of the data lines P. The fault test enable circuit 34 applies a high signal 35 to an input to AND gate 46. Connected to another input to AND gate 46 is a reset signal NRESET 37. Assuming signal NRESET 37 is also high, the output 47 of AND gate 46 operates to close switch 40 in the detection circuit 32. At this same time, the address A–Am, head select SEL 13, and the data lines P–Pn are not driven. If a path to ground exists, the data lines would not be at a high impedance state. Instead, a current would flow from the current source through switch 40, through a diode(s) 36, and through the fault (such as a path to ground), pulling node 38 to a low state. The signal at node 38 is then detected using the voltage comparator 44. For example, if the voltage on node 38 goes to a low state, an output signal 45 of the voltage comparator 44 will change, for example, from a high to a low state. The output signal 45 from the voltage comparator 44 is provided as an input to AND gate 48. There it is combined with the inverted OVERCURRENT signal 49 which has first been inverted at inverter 50. When a fault is detected, or when an overcurrent condition is detected (i.e., the OVERCURRENT signal goes to a high state) by an overcurrent sensor (not shown), the output of AND gate 48, signal OK2PRINT 51, changes to a low state to indicate the presence of a fault. This signal OK2PRINT 51 is communicated to control logic 30, which provides feedback to the user of the device.

The printhead controller 16 is also connected to the printhead identification device 14. One example of a printhead identification device is described in U.S. Pat. No. 6,161,915, hereby incorporated by reference. Such a device 14 may be manufactured as part of a printhead cartridge. When an ink jet printer is first operated or when a new printhead cartridge is installed in the ink jet printer, the controller 16 receives information from the printhead identification device 14 regarding the type of printhead cartridge installed. The controller 16 uses this information to properly activate the control signals sent to the printhead. However, in some cases, the controller 16 is not able to properly detect the type of printhead installed. For example, the printhead identification device 14 may have been improperly manufactured, or damaged during shipping or handling.

In the event that the printhead controller 16 fails to properly identify an installed printhead, the printhead controller 16 operates to detect the presence of the installed printhead 12. This is accomplished by biasing the FETs 18 in a predetermined manner via one or more address lines, and detecting a signal via the data lines, in particular, by detecting the voltage on node 38, in a manner similar to that used to detect faults. If the printhead 12 is actually installed, the output of the comparator 44 would indicate the presence of the printhead 12, and would allow the controller 16 to provide signals to the printhead to print.

Specifically, when the printhead controller 16 fails to properly identify an installed printhead, the control logic circuit 30 operates to provide a signal to the fault test enable circuit 34, which then outputs a signal, for example a high signal, to the AND gate 46. Assuming that the NRESET signal is also set to high, a high signal from AND gate 46 is transmitted to the detection circuit 32, operating to close the switch 40. At the same time, the control logic circuit 30 controls the head select driver 26 and at least one address line driver to bias the associated FETS in each group 20. At this time, the data line drivers 24 do not transmit signals to the data lines P. With an active signal on the head select line SEL, a path is created from the data lines to ground. With an active signal on line A1, for example, ample current is provided to pull node 38 to a low state, yet without providing enough current to activate the heater resistor to eject ink, If a printhead 12 is present, the output signal 45 of the comparator 44 will change, for example, from a high to a low state. Further, the OK2PRINT 51 signal will change from a high to low state. These signals indicate the presence of an installed printhead.

The functionality of the printhead 12 can be checked in a more rigorous manner by providing active signals on each address line sequentially and checking that the OK2PRINT signal changes state each time an address line is activated.

The described embodiment of the system and method for the detection of printhead presence is advantageous to extend the capabilities of an existing printhead identification device 14. Although the detection circuit 32 in the described embodiment provides less information to the printhead controller 16 than does a fully operational printhead identification device, and hence some information regarding the printhead is not available, the ability of the detection circuit 32 to discern with certainty printhead presence provides benefit to the user of the ink jet printer. In other words, this system and method are designed to be an additional effort to confirm that a printhead is truly missing, and if it is not, to allow the ink jet printer to still operate. The advantages of such a system and method extend to the manufacturer of the ink jet printer and/or printhead, due to fewer customer support calls and fewer frustrations experienced by a user. Further, this method is advantageous in that it may make use of existing circuitry in a manner that is simple and cost-effective to implement.

The foregoing description of several methods and an embodiments of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto. Various features and advantages of the invention are set forth in the following claims.

What is claimed is:

1. A system for detecting the presence of an ink jet printhead, comprising:

a printhead including an array of thermally activated heater elements for ejecting ink, each heater element having an associated control element, a printhead identification device, and a printhead controller including address line drivers and data line drivers for transmitting signals to the printhead via a plurality of address lines and data lines, respectively, to selectively activate the heater elements for ejecting ink, the printhead controller receiving information from the printhead identification device to identify the type of printhead installed, and when the printhead controller fails to properly identify an installed printhead, the printhead controller operates to bias at least one of the control elements in a predetermined manner via at least one address line, detect a signal via the data lines, and generate a signal indicative of the presence of the installed printhead.

2. The system of claim 1, wherein the control elements are field effect transistors each having a source, a drain, and a gate, each transistor having its associated heater element connected between the printhead controller and one of the source and the drain, with an associated address line coupled to the gate.

3. The system of claim 2, wherein the field effect transistors are biased in the predetermined manner by generating a predetermined voltage signal on at least one of the address lines.

4. The system of claim 3, wherein a plurality of field effect transistors are biased in the predetermined manner by providing predetermined voltage signals sequentially on a plurality of address lines to sequentially generate a predetermined voltage signal on the data lines.

5. The system of claim 1, wherein the printhead controller includes a detection circuit that detects a signal via the data lines, and the detection circuit also functions as a fault detection circuit for detecting faults on the data lines.

6. The system of claim 1, wherein the printhead controller further includes a head select line, and a predetermined signal on the head select line allows a signal on an address line to bias associated control elements in the predetermined manner.

7. The system of claim 1, wherein a plurality of diodes are each connected at a first terminal to one of the data lines and are connected at a second terminal to an electrically common node.

8. The system of claim 7, wherein a voltage at the node is coupled to an input terminal of a switch that is actuated when the printhead controller fails to properly identify a printhead.

9. The system of claim 8, wherein an output terminal of the switch is connected to a comparator.

10. The system of claim 9, wherein the output terminal of the switch is also connected to a current source.

11. The system of claim 1, wherein the printhead is in the form of a printhead cartridge, and the printhead identification device is on the printhead cartridge.

12. The system of claim 11, wherein the printhead identification device is a circuit.

13. The system of claim 1, wherein the signal indicative of the presence of an installed printhead then permits the printhead controller to transmit signals to the printhead to print a desired image.

14. In an ink jet printer having printhead controller, a printhead identification device, and an ink jet printhead that includes an array of thermally activated heater elements having corresponding data lines and address lines, each heater element having an associated control element and an associated nozzle for ejecting ink, a method for detecting the presence of the ink jet printhead, comprising:

identifying the type of installed printhead using the printhead controller based on information from a printhead identification device, and using, in the event that an installed printhead is not identified, the printhead controller to bias a plurality of the control elements via at least one address line, to detect a signal via a plurality of data lines connecting the ink jet printhead and the printhead controller, and to produce a signal indicative of the presence of the installed printhead.

15. The method of claim 14, wherein the signal indicative of the presence of the installed printhead is used to enable the printhead controller to subsequently provide signals to the printhead for printing.

16. The method of claim 14, wherein the control elements are field effect transistors each having a source, a drain, and a gate, each transistor having an associated heater element that is connected between the printhead controller and one of the source and the drain, with an associated address line coupled to the gate, and each field effect transistor is biased in the predetermined manner by generating a predetermined voltage signal on each of the plurality of address lines.

17. The method of claim 16, wherein each field effect transistor is sequentially biased in the predetermined manner to sequentially generate a predetermined voltage signal on an associated one of the data lines.

18. The method of claim 14, wherein the printhead controller further includes a head select line and an inactive signal on the head select line prevents signals on the address lines from biasing the control elements in the predetermined manner, and in the event that an installed printhead is not properly identified, providing an active signal on the head select line to permit signals on the address lines to bias the control elements in the predetermined manner.

19. The method of claim 14, wherein a plurality of diodes are each connected at a first terminal to one of the data lines and connected at a second terminal to an electrically common node, the method including the step of determining the voltage at the node and generating based on the determined voltage a signal indicative of the presence of the printhead.

20. The method of claim 14, including the further step of using the printhead controller to control the printhead to print a desired image once the presence of the printhead is determined.

* * * * *